US005082425A

United States Patent [19]

Reil et al.

[11] Patent Number: 5,082,425

[45] Date of Patent: Jan. 21, 1992

[54] CENTRIFUGAL PUMP IMPELLER

[75] Inventors: Axel Reil, Frankenthal; Rolf Scherer, Hessheim; Jörg Starke, Eppelsheim, all of Fed. Rep. of Germany; Renzo Ghiotte; Primo Lovisetto, both of Vicenza, Italy

[73] Assignee: KSB Aktiengesellschaft, Frankenthal, Fed. Rep. of Germany

[21] Appl. No.: 466,451

[22] PCT Filed: Sep. 9, 1988

[86] PCT No.: PCT/EP88/00823

§ 371 Date: May 17, 1990

§ 102(e) Date: May 17, 1990

[87] PCT Pub. No.: WO89/02538

PCT Pub. Date: Mar. 23, 1989

[30] Foreign Application Priority Data

Sep. 17, 1987 [DE] Fed. Rep. of Germany ..... 3731161

[51] Int. Cl.[5] ..... F04D 29/38

[52] U.S. Cl. ..... 416/188; 416/190; 416/213 R; 416/223 B

[58] Field of Search ..... 415/228; 416/213 R, 416/213 A, 204 R, 223 B, 179, 182, 185, 188, 190

[56] References Cited

U.S. PATENT DOCUMENTS 4,342,541 8/1982 Leskinen ..... 416/188

4,795,311 1/1989 Arkhipov et al. ..... 416/223 B 4,806,078 2/1989 Heumann ..... 415/228

FOREIGN PATENT DOCUMENTS 2622823 12/1976 Fed. Rep. of Germany ... 416/213 R 2067673 7/1981 United Kingdom ..... 416/213 R

*Primary Examiner*—Edward K. Look

*Assistant Examiner*—Christopher M. Verdier

*Attorney, Agent, or Firm*—Peter K. Kontler

[57] ABSTRACT

An impeller for a centrifugal pump has a hub which is designed to be affixed to the pump shaft. The hub carries a first cover plate which is located at the pressure side of the impeller and supports a series of vanes defining flow channels. The first cover plate is secured to the bases of the vanes and a second cover plate situated at the suction side of the impeller abuts the tops of the vanes and overlies the flow channels. A suction port constituting an individually manufactured component is disposed at the inlet of the impeller and has a section of constant diameter which faces away from the vanes as well as a section of variable diameter which confronts the vanes. The section of variable diameter is connected to the tops of the vanes by a weld seam. The second cover plate overlies that end portion of the suction port having the greatest diameter and is secured to the tops of the vanes in an area between the suction port and the impeller outlet. The cover plates and the suction port are all made of sheet material.

16 Claims, 2 Drawing Sheets

CENTRIFUGAL PUMP IMPELLER

BACKGROUND OF THE INVENTION

The invention relates to a centrifugal pump impeller.

Impellers for centrifugal pumps can be produced in various ways. In the so-called closed impellers, vanes defining the impeller channels are disposed between two cover plates. These impellers are generally made from castings or sheet material. Casting has the drawback that impellers having narrow outlets cannot be produced by this method because the very narrow casting cores which determine the cross section of the vane channels present difficulties. The British Patent Specification No. 537 727 sets forth a solution for this problem in that a so-called open impeller is produced and converted into a closed impeller by means of a cover plate constituting a separate structural component. For this purpose, a cover plate in the form of a casting having integrally cast vanes is manufactured. This is possible without the use of complicated parts. The small vane height obtained in this manner and the subsequently applied cover plate, which can be riveted or screwed to the vanes at each of a plurality of locations, yield impellers having narrow cross sections.

The German Patent Nos. 509 458 and 737 000 show impellers whose vaneless, suction side cover plates abut vaned, pressure side cover plates and are releasably connected with the impeller hubs. The pumps in question here are for use in the food industry where access to the interior of the impeller, and hence a removable impeller cover plate, are necessary for better cleaning.

From the U.S. Pat. No. 1,849,557, it is known to produce a vaned blank which is just within the limits of casting feasibility. The vanes are exposed in the region of the impeller outlet. By treating the exposed portions of the vanes, e.g., mechanically, the vane width is brought to the hydraulically required dimension and the impeller is thereafter covered using separate cover plates.

The British Patent Specification No. 728 972 illustrates an impeller for centrifugal pumps which is assembled from a plurality of thick-walled components. To prevent damage by cavitation in the inlet region, the flow-directing components are coated with stainless steel or components consisting of stainless steel are used. The suction side cover plate is divided into two parts including a cylindrical inlet ring which forms the suction port and a bent impeller cover plate which is welded thereto in a fluidtight fashion. The vanes themselves, in turn, are welded to the suction side and pressure side cover plates throughout.

Other known solutions such as, for example, that in the U.S. Pat. No. 2,344,444, reside in impellers which are made entirely of sheet material and are assembled from a plurality of individual components. These impellers are predominantly used in the so-called private sector, that is, for applications where low pumping capacities suffice. The use of sheet material impellers for applications requiring large capacities, e.g., standard chemical pumps and the like, creates difficulties in that the impellers do not have the strength to withstand the loads which arise. The consequences are cracks and complete rupture of welds due to overloads, vibrations and the like.

SUMMARY OF THE INVENTION

It is an object of the invention to provide a construction for centrifugal pump impellers assembled from individual sheet material components which is suitable for high rotational speeds (up to approximately 4300 rpm) and not susceptible to static and dynamic loading.

According to the invention, a suction port which constitutes a separate structural component is affixed in the inlet region of the impeller to produce a very rigid inlet part. The remaining open region of the impeller is closed by a vaneless cover plate which abuts the vanes and is secured thereto. The feature that the vaneless cover plate is not connected to the suction port makes it possible to produce centrifugal pump impellers capable of being very highly loaded. In the known constructions, the required strength is achieved by holding the individual impeller components together via a large number of connections, preferably welded connections. The strength is here increased by increasing the number of welded connections or by using reinforcing components.

The construction according to the invention is in complete contrast. It has been recognized that it is essential to have a good connection between the vanes and the force-conducting cover plate. The design in accordance with the invention functions to prevent stressing or deformation of the impeller which could lead to rupture of the individual components in the area of the connections. The very high loads in the inlet region of the impeller are reliably taken up by the very rigid union between the suction port and the vanes. The lesser loading in the outlet region of the impeller is taken into consideration by using a vaneless cover plate which is decoupled from the inlet region of the impeller and covers the remaining region of the latter. Furthermore, the decoupling prevents transmission of the various deformations to the respective other component.

An embodiment of the invention provides for the vaneless cover plate to be welded to the vanes. In another embodiment of the invention found to be advantageous, the welds for securing the vaneless cover plate to the vanes are located at a uniform distance from the rotational axis. As compared to the known designs where a large number of connections are provided between a vane and the impeller cover plates, this construction represents a departure from conventional design principles. By reducing the number of connecting points or weld locations on the vaneless cover plate to the minimum required for attachment of the same, an elasticity is achieved which allows equalization of the deformations arising during operation.

According to a further embodiment of the invention, the locus of attachment of the suction port lies on a conical surface which defines a cone half-angle alpha of 40 degress to 65 degrees with the rotational axis. The point of intersection of the conical surface with the rotational axis is defined by a perpendicular taken at the outer diameter of the impeller to the rotational axis. Experiments have shown that an extraordinarily high rigidity of the vane formation is obtained by arranging the locus of attachment of the suction port to the vane formation in the manner described. The attachment is preferably effected by a welded connection. Due to the lack of a connection between the suction port and the vaneless cover plate, a decoupling exists thereby preventing destruction of the connection or welds.

An additional embodiment of the invention provides for the maximum outer diameter of the suction port to be at most 25mm larger than the inlet diameter. This measure not only ensures that the suction port can be readily shaped but also ensures adequate overlap of the vane inlet so that the inlet region of the impeller is reinforced.

A further embodiment of the invention provides for one or more shaped components, which are made of sheet material and form the vanes, to be secured to the force-transmitting cover plate. The vaned cover plate, which is directly responsible for the transmission of force between the drive motor and liquid to be conveyed, has a suitable connection to the pump shaft. The connections between the force-transmitting cover plate and the vanes mounted on the same are appropriately dimensioned in dependence upon the power to be transmitted.

In an additional embodiment of the invention, the vaned cover plate is provided with corrugations which are disposed betweem the vanes and are shaped like the vane channel. This measure ensures that the centrifugal pump impeller has outstanding rotational characteristics. A further advantage is derived when using a vane whose base is bent relative to the flow-directing upper surface of the vane so as to define an L shape. It can be secured between the individual corrugations, and a particularly smooth flow channel is obtained when the depth of the corrugation equals the thickness of the base of the vane. In the opposite case where the bases of the vanes are fixed directly to the corrugations, an increase in the width of the impeller outlet is achieved.

BRIEF DESCRIPTION OF THE DRAWINGS

Preferred embodiments of the invention are illustrated in the accompanying drawings wherein.

DESCRIPTION OF THE PREFERRED EMBODIMENTS

Figure 1:
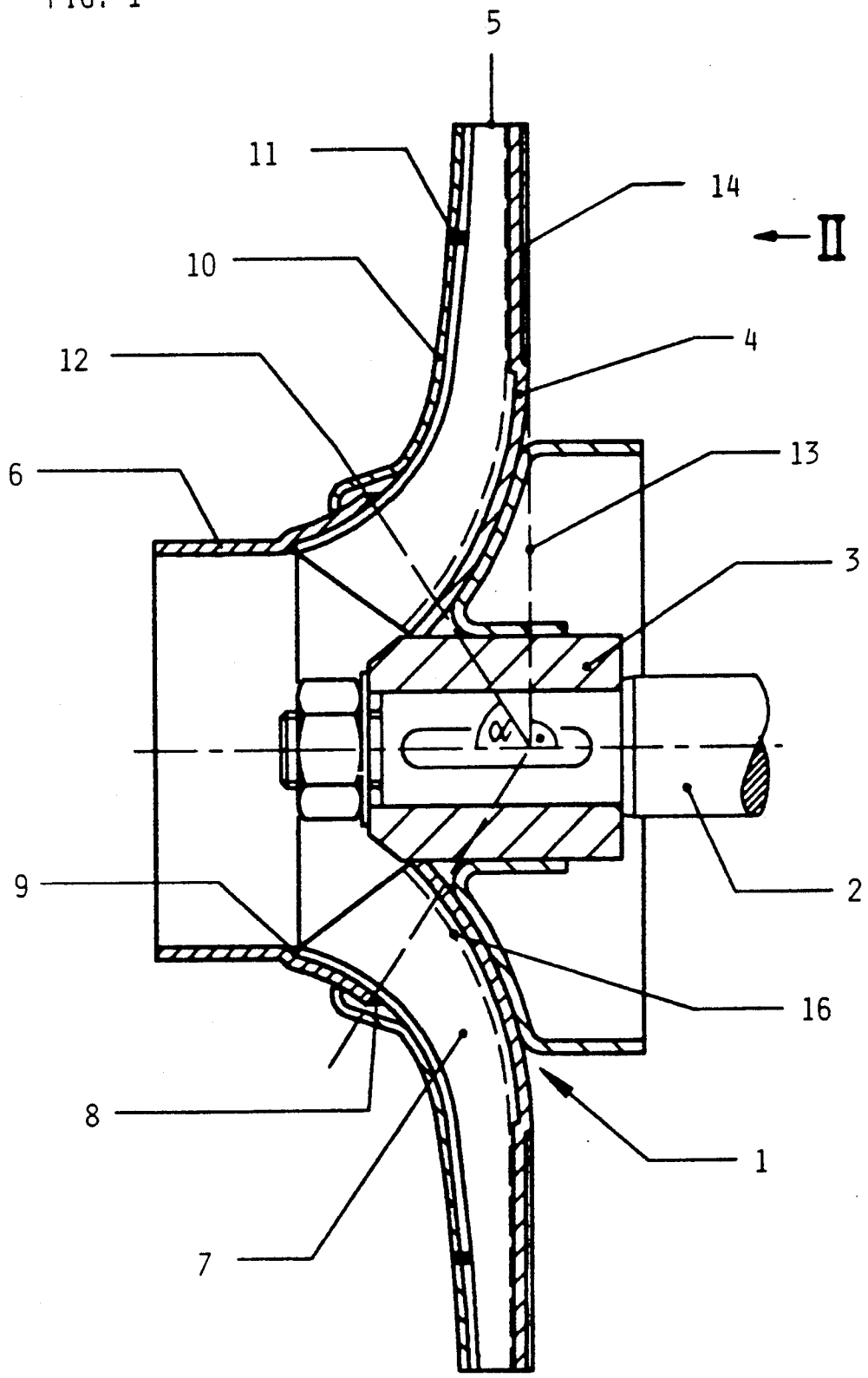
FIG. 1 is a section through an impeller design in accordance with the invention.

A section through the impeller 1 of the invention is shown in FIG. 1. A hub 3 which serves to conduct the forces to be transmitted into a vaned cover plate 4 is disposed on a pump shaft 2. In this exemplary structure, a plurality of vanes 5 are secured to the vaned cover plate 4 by means of welds. Soldered or adhesive connections are also possible. Vanes having the most diverse shapes can be used and it is only important to provide a reliable connection between the force-transmitting cover plate and the bases of the vanes. This can be assured in a simple manner, e.g., via the number of welds, the dimensions of the material and the shaping procedure.

A suction port 6 constructed as a separate structural component is mounted at the inlet region of the impeller, covers the inlet region of the vane channels 7 and is directly secured to the vanes 5. The attachment is here achieved by a welded seam 8 which produces a connection to the vanes 5 or their tops in the region of the largest diameter of the suction port 6. Conventional welding. soldering or adhesive procedures can be used to connect these components. A welded seam 9 can also be disposed directly in the inlet region of the impeller or therebetween. The vaneless cover plate 10 directly abuts the vanes 5 or their tops and is connected to these by spot welds 11. The spot welds 11 are here arranged in a circle whose diameter is smaller than the outer diameter of the impeller. A possible reduction in the outer diameter of the impeller using a conventional turning process does not affect the strength of the structure.

The connection between the vanes 5 and the suction port 6 lies on the imaginary surface of a cone 12 illustrated in broken lines. The cone half-angle (alpha) defined by the rotational axis and the cone surface is of of the order of 40 degrees to 65 degrees. The intersection of the cone and the rotational axis is that point at which a tangent 13 to the outer side of the vaned cover plane, and which is normal to the rotational axis, cuts the latter.

Figure 2:
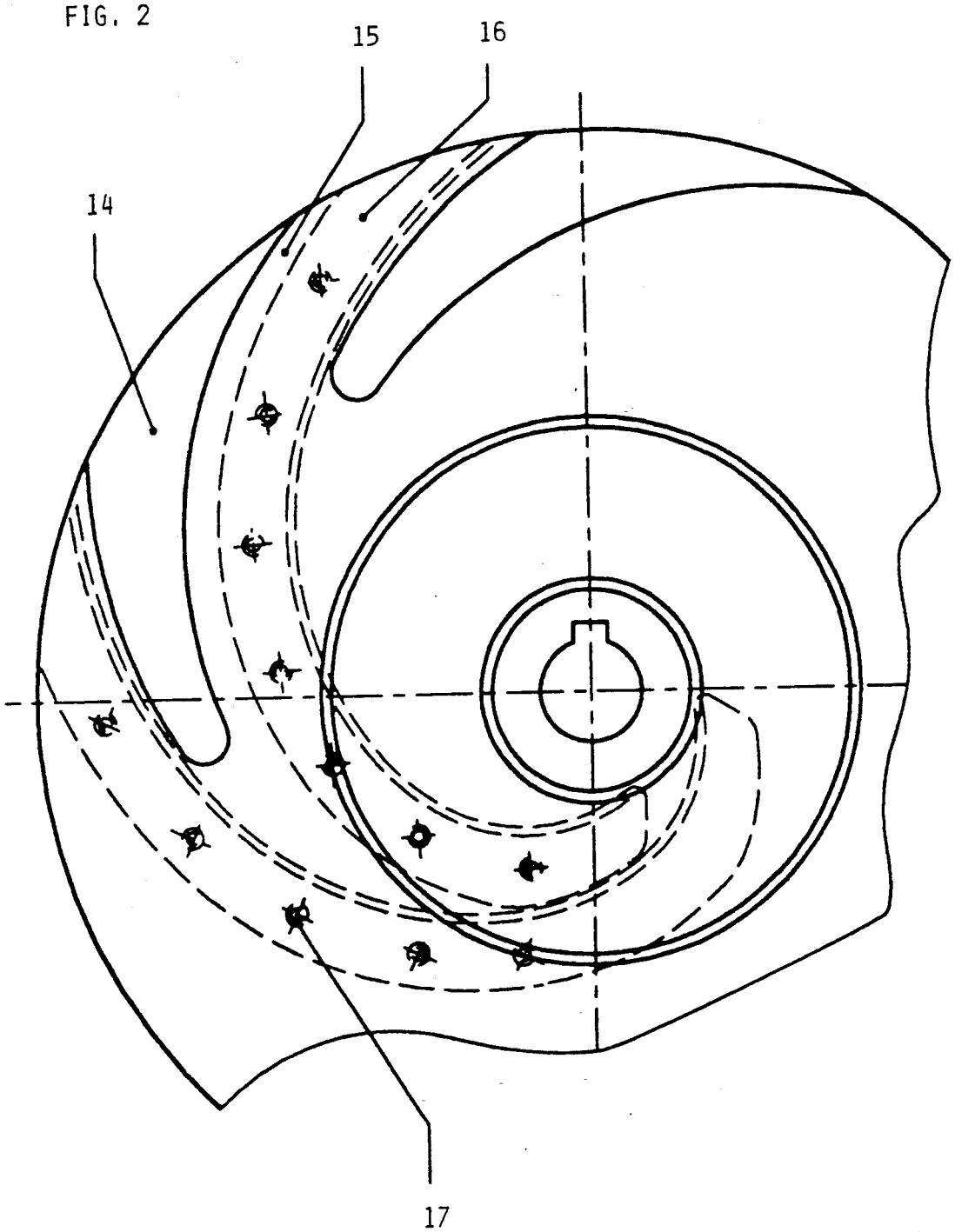
FIG. 2 is a plan view of the vaned cover plate as seen in the direction of the arrow II of FIG. 1.

FIG. 2 is a plan view of the vaned cover plate and an elevational view of the rear side of the impeller. The corrugations 14 embossed herein extend along a path which corresponds to that of the vane channels 7. The corrugations 14 are merely indentations which are embossed in the outer side of the vaned cover plate 4 to form protrusions on the inner side of the plate 4. Referring also to FIG. 2, areas 15 remaining between the corrugations serve to receive the bases 16 of the vanes. The depths of the corrugations 14 here equals the thickness of the bases 16 of the vanes which results in a smooth vane channel. The bases 16 of the vanes are here connected to the vaned cover plate 4 by a plurality of spot welds 17.

We claim:

1. An impeller, said impeller having an inlet side and an outlet side and comprising a member which includes a first cover at said outlet side and a plurality of guiding elements for fluid fastened to said first cover, said guiding elements defining flow channels for fluid; an inlet element of variable diameter having a portion of maximum diameter, said inlet element and said member constituting different components; first means non-releasably connecting said inlet element to said guiding elements at said inlet side; a second cover at said inlet side bounding said flow channels and having a section which overlies said portion of said inlet element; and second means connecting said second cover to said guiding elements at a location between said outlet side and said inlet element.

2. The impeller of claim 1, wherein said member further includes a hub for the conduction of forces to and from said member.

3. The impeller of claim 1, wherein said second connecting means comprises a weld.

4. The impeller of claim 3, wherein said member has an axis of rotation and said second connecting means comprises a plurality of welds, all of said welds being disposed at substantially the same distance from said axis.

5. The impeller of claim 1, wherein said member has an axis of rotation and said first cover has an external surface, said guiding elements having end faces which confront said second cover, and at least part of said first connecting means being located on a curve defined by the intersection of said end faces with a cone, said cone having a vertex at the intersection of said axis with a line substantially tangential to said external surface and substantially perpendicular to said axis.

6. The impeller of claim 5, wherein said axis and said cone define an angle of about 40 degrees to about 65 degrees.

7. The impeller of claim 1, wherein said inlet element defines an inlet opening of predetermined diameter and has a maximum outer diameter which is at most about 25mm greater than said predetermined diameter.

8. The impeller of claim 1, further comprising a seal in the region of overlap of said portion and said section.

9. The impeller of claim 1, wherein said guiding elements comprise sheet material.

10. The impeller of claim 1, wherein said first cover is provided with corrugations.

11. The impeller of claim 10, wherein each of said corrugations is located between two neighboring guiding elements.

12. The impeller of claim 11, wherein each of said corrugations extends along the flow channels defined by the respective guiding elements and has substantially the same contour as the flow channel.

13. The impeller of claim 1, wherein said member has an axis of rotation and said second connecting means, in its entirety, is disposed at a substantially uniform distance from said axis, said second connecting means constituting the sole connecting means between said second cover and said guiding elements.

14. The impeller of claim 1, wherein said second cover is free of direct connection to said inlet element.

15. The impeller of claim 1, wherein said second cover is elastically deformable and said second connecting means connects said second cover to said guiding elements so as to permit elastic deformation of said second cover.

16. The impeller of claim 1, wherein said covers, said guiding elements and said inlet element consist essentially of sheet material.

* * * * *